US006631812B2

(12) United States Patent
Ruiz

(10) Patent No.: US 6,631,812 B2
(45) Date of Patent: Oct. 14, 2003

(54) STEMWARE SUSPENDERS

(76) Inventor: Emilio Ruiz, 180 Mailands Rd., Fairfield, CT (US) 06430

( * ) Notice: Subject to any disclaimer, the term of this patent is extended or adjusted under 35 U.S.C. 154(b) by 0 days.

(21) Appl. No.: 09/999,011

(22) Filed: Oct. 30, 2001

(65) Prior Publication Data

US 2003/0080077 A1 May 1, 2003

(51) Int. Cl.[7] ..... A47G 29/00

(52) U.S. Cl. ..... 211/85.29; 211/113; 211/59.2; 211/74; 248/311.2

(58) Field of Search ..... 211/113, 85.29, 211/71.01, 87.01, 74, 59.2, 162; D6/466, 467, 513, 567, 574, 512; D7/701, 703, 704, 708, 620, 602; 248/312, 312.1, 311.2, 309.1, 311.3

(56) References Cited

U.S. PATENT DOCUMENTS

| | | | | | |
|---|---|---|---|---|---|
| 952,107 | A | * | 3/1910 | Furber | 211/74 |
| 1,456,728 | A | * | 5/1923 | Frank | 211/74 |
| 1,580,741 | A | * | 4/1926 | Lilly | 211/74 |
| 1,925,540 | A | | 9/1933 | Neuschotz | |
| 2,703,253 | A | * | 3/1955 | Biederman | 211/74 |
| 2,996,938 | A | * | 8/1961 | Holtzclaw et al. | 211/74 |
| 3,022,899 | A | * | 2/1962 | Unsworth | 211/71 |
| 3,154,196 | A | * | 10/1964 | Loska, Jr. et al. | 211/71 |
| 3,192,894 | A | * | 7/1965 | Staver | 118/76 |
| 3,214,031 | A | * | 10/1965 | McCauley | 211/71 |
| 3,491,893 | A | | 1/1970 | Morris | |
| 4,022,363 | A | * | 5/1977 | Eliassen | 224/45 AA |
| 4,228,905 | A | | 10/1980 | Cammarota | |
| D259,452 | S | * | 6/1981 | Hoffman | D6/113 |
| 4,325,486 | A | | 4/1982 | Neal | |
| D267,914 | S | | 2/1983 | Lin | |
| D269,926 | S | * | 8/1983 | White | D6/113 |
| D273,446 | S | | 4/1984 | Rankin et al. | |
| D275,433 | S | | 9/1984 | Boland, II | |
| 4,589,556 | A | * | 5/1986 | Peretz | 211/41.2 |
| 4,905,949 | A | * | 3/1990 | Cosgrove | 248/312.1 |
| D307,990 | S | * | 5/1990 | Funk | D6/512 |
| D308,924 | S | * | 7/1990 | VanNoord | D6/513 |
| D329,153 | S | * | 9/1992 | Kijanka et al. | D6/467 |
| 5,586,665 | A | * | 12/1996 | Brousseau | 211/59.2 |
| 5,595,310 | A | * | 1/1997 | Spamer et al. | 211/59.2 |
| D381,854 | S | | 8/1997 | Moeller et al. | |
| 5,711,436 | A | | 1/1998 | Moeller et al. | |
| 5,715,953 | A | * | 2/1998 | Brown | 211/74 |
| D392,822 | S | | 3/1998 | Gilmore | |
| D393,388 | S | * | 4/1998 | Chen | D6/513 |
| 5,755,341 | A | | 5/1998 | Spamer | |
| 5,785,189 | A | * | 7/1998 | Gollob et al. | 108/109 |
| 5,964,359 | A | * | 10/1999 | Marino, Jr. | 211/74 |
| D416,722 | S | * | 11/1999 | Hartwall | D6/533 |
| 6,357,607 | B1 | * | 3/2002 | Wu | 211/75 |
| 6,394,288 | B1 | * | 5/2002 | Hartwall | 211/59.2 |

* cited by examiner

*Primary Examiner*—Daniel P. Stodola
*Assistant Examiner*—Jennifer E. Novosad
(74) *Attorney, Agent, or Firm*—David Aker

(57) ABSTRACT

A stemware suspender includes a generally rectangular frame; and a support member extending from the frame, the support member being sized, shaped and positioned so as to define an opening for receiving a stem of a piece of stemware, the support member being angled with respect to the frame so that a base of the piece of stemware is centered between opposite sides of the frame when the base is supported in the suspender. A plurality of the stemware suspenders may be mounted on a base plate, to assist in installation of multiple suspenders. A kit may include appropriate hardware for mounting the stemware suspenders to a surface. A method for efficiently utilizing space by mounting the stemware suspenders individually or when associated with base plates so that stemware pieces placed in suspenders on facing surfaces are disposed adjacent to one another.

23 Claims, 8 Drawing Sheets

STEMWARE SUSPENDERS

BACKGROUND OF THE INVENTION

1. Field of the Invention

The present invention relates to apparatus for safely, efficiently and aesthetically storing stemware. More particularly, it relates to devices for suspending stemware.

2. Prior Art

The use of stemware for serving wine, liqueurs, champagne, or any other beverage adds to the charm and elegance of any occasion. Those owning such stemware have the burden of finding ways in which to safely store such stemware, as it may be easily broken by falling over or by being impacted by other glassware of far lesser value.

A variety of stemware suspenders are known in the prior art. These include large and bulky solid structures which are difficult to manufacture, expensive and take up a large amount of space. They also include wire structures, which have some of the same disadvantages. These structures are not aesthetically pleasing and do not offer an efficient solution to the problem of storing stemware so that it is safe, readily available for use, and so that its aesthetic appeal may be visible prior to use. Further, these structures often may only be mounted to other structures in a single non-optimal manner, which may not be generally desirable. For example, it may be necessary to make holes in fine cabinets, thus providing an installation that can not be easily modified without great expense to make necessary repairs, such as replacing parts in which holes have been made. In other words, these arrangements are generally inflexible.

SUMMARY OF THE INVENTION

It is an object of the invention to provide a stemware suspender that safely, efficiently and elegantly stores stemware.

It is an another object of the invention to provide a stemware suspender that is easy and inexpensive to manufacture.

It is yet another object of the invention to provide a stemware suspender that is easily mounted in a variety of places and by a variety of mounting means, so that there is a great deal of flexibility in the manner in which shelf space is utilized.

In accordance with the invention, a stemware suspender comprises a generally rectangular frame; and a support member extending from the frame, the support member being sized, shaped and positioned so as to define an opening for receiving a stem of a piece of stemware, the support member being angled with respect to the frame so that a base of the piece of stemware is centered between opposite sides of the frame when the base is supported in the suspender. The stemware suspender may further comprise a plurality of parallel ribs on an inner surface of each of the support members, the ribs being for contacting the base of the stemware and for further assisting in centering the stemware.

The stemware suspender may further comprise an end wall extending from each of the support members in a direction substantially perpendicular to a plane defined by the frame. A side wall may be disposed between each of the support members and the frame. The side walls may be angled inward towards each other as distance from the frame is increased.

The stemware suspender may further comprise a web of the frame, the web having openings at least as large as projections of the support member on the web. The web may have a plurality of openings therein for receiving a fastener for fastening the suspender to a surface. The stemware suspender may further comprise a boss associated with each of the openings, the boss having a surface in a common plane with a surface of the frame. There may be three openings.

The frame may have a planner surface for abutting a surface to which the suspender is to be mounted.

The invention is also directed to a kit including at least one stemware suspender in combination with fastening means for fastening the stemware suspender to a surface. The fastening means may include at least one of screws, nails, an adhesive and clips for fastening the suspender to a shelf.

The stemware suspender may further comprise at least one protrusion extending from the frame at an end of the frame, the protrusion being sized, shaped and positioned so as to prevent the stemware from leaving the suspender from the end having the protrusion. The frame may have two protrusions extending therefrom. The stemware suspender may further comprise at least one protrusion extending from one of the support members at an end of the support member. Each of the support members may have a protrusion extending therefrom.

The invention is also directed to an apparatus for supporting stemware comprising a planar base; and a plurality of stemware suspenders affixed to one side of the base, each stemware suspender including a generally rectangular frame; and a support member extending from the frame, the support member being sized, shaped and positioned so as to define an opening for receiving a stem of a piece of stemware, the support member being angled with respect to the frame so that a base of the piece of stemware is centered between opposite sides of the frame when the base is supported in the suspender.

The invention also is directed to a method for mounting stemware suspenders to two parallel surfaces in facing relationship, comprising mounting a plurality of stemware suspenders to a first surface of the parallel surfaces; mounting at least one of the stemware suspenders to a second of the parallel surfaces; the stemware suspenders being placed on the first surface and on the second surface so that stemware placed in the plurality of suspenders on the first surface is disposed on either side of stemware place in the suspender placed on the second surface. Each of the suspenders may comprise a generally rectangular frame; and a support member extending from the frame, the support member being sized, shaped and positioned so as to define an opening for receiving a stem of a piece of stemware, the support member being angled with respect to the frame so that a base of the piece of stemware is centered between opposite sides of the frame when the base is supported in the suspender.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENTS

Figure 1:
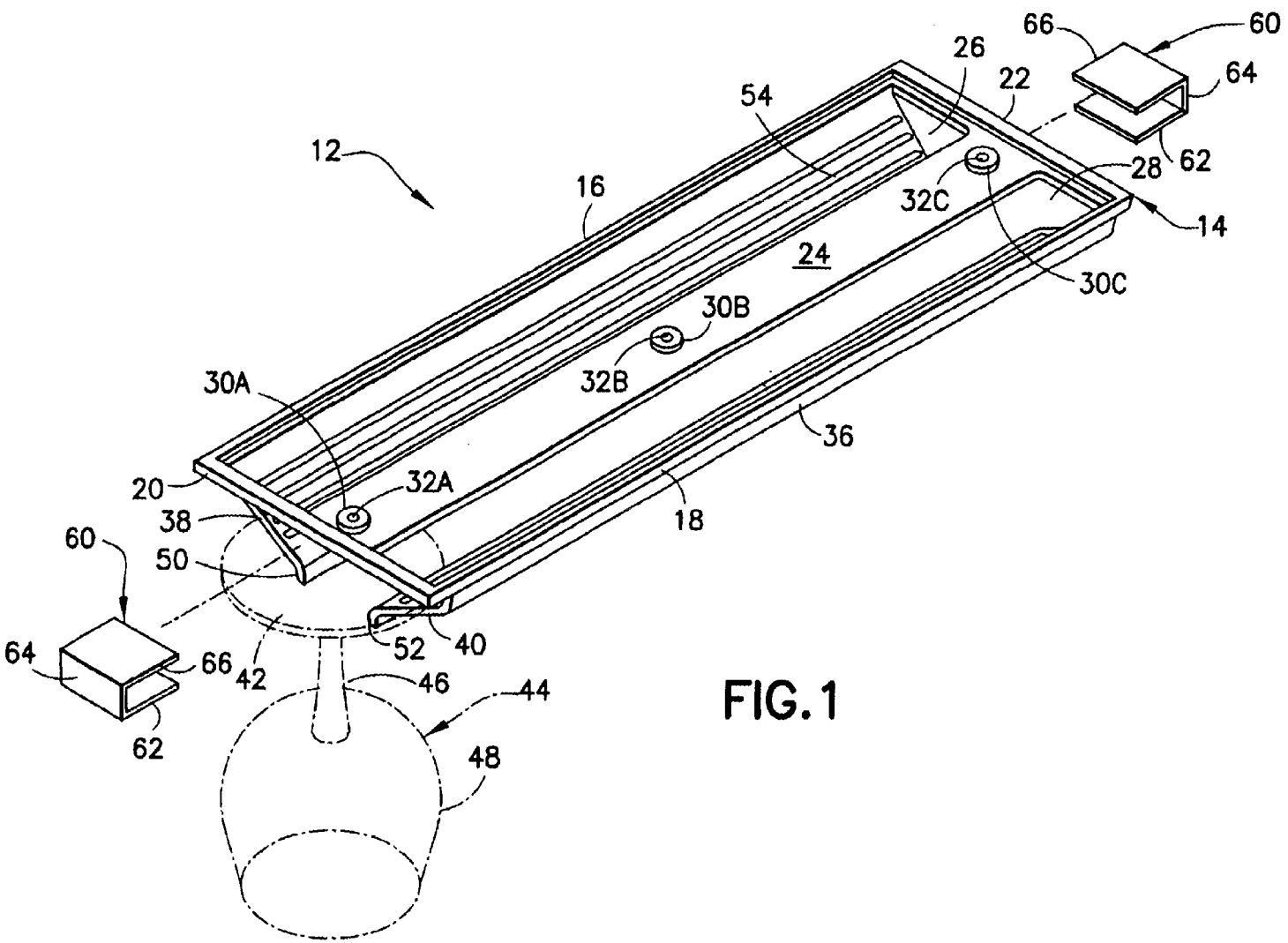
FIG. 1 is a perspective view of a stemware suspender in accordance with a first embodiment of the invention.
Figure 2:
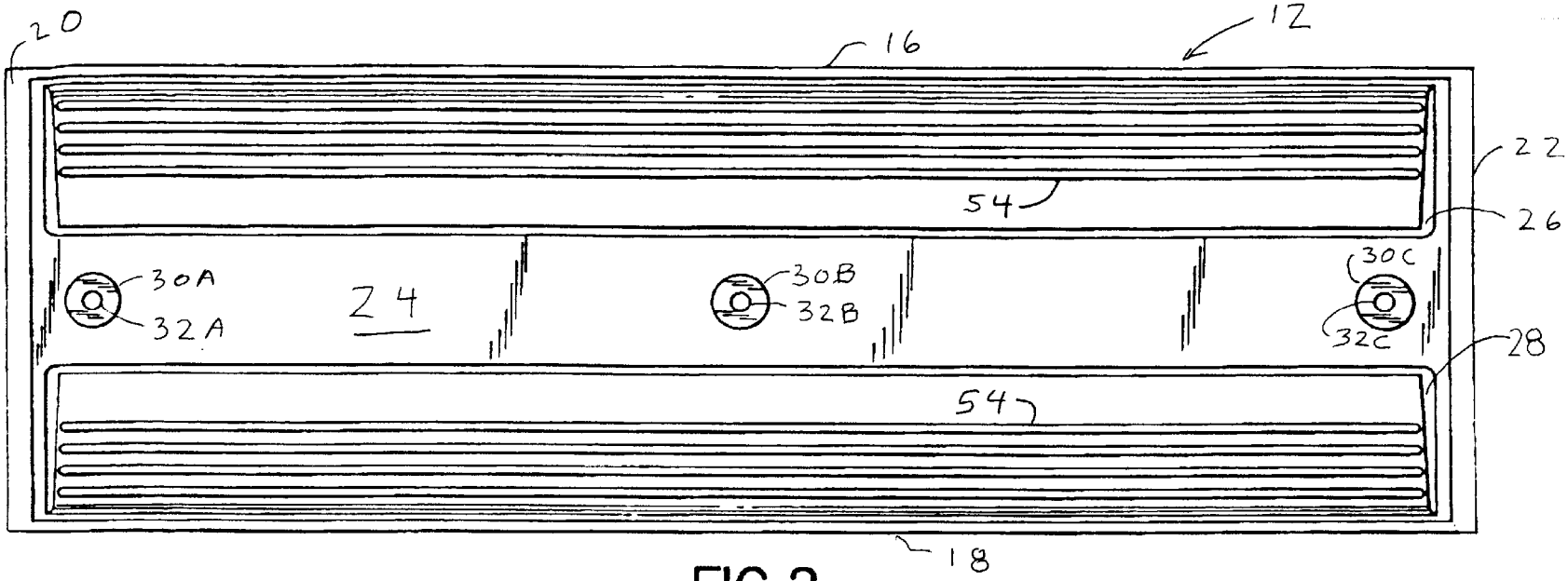
FIG. 2 is a top view of the stemware suspender in accordance with the embodiment of the FIG. 1.

Referring to FIG. 1, there is shown a perspective view of a stemware suspender 12 incorporating features of the present invention. Although the present invention will be described with reference to the embodiments shown in the drawings, it should be understood that the present invention can be embodied in many alternate forms of embodiments. In addition, any suitable size, shape or type of elements or materials could be used.

Suspender 12 is advantageously formed of a polymer material, such as a rigid clear or white vinyl, or a polymethylmethacrylate or other suitable polymer by a process such as injection molding, or by extrusion followed by machining. For the most elegant appearance, a clear, transparent material may be used. However, coloring material may be included to provide a tint or an opaque object.

Referring to FIGS. 1 to 5, suspender 12 includes a frame 14 having side members 16 and 18, a front member 20 and a rear member 22, all integrally formed. An integral web 24 of frame 14 is shaped so as to define a first elongate opening 26 and a second elongate opening 28. Web 24 has three raised cylindrical bosses 30A, 30B and 30C. Each boss has a respective hole 32A, 32B and 32C through which a fastener, such as a screw may extend, for mounting suspender 12 to a suitable surface. Alternatively, as described below, other mounting techniques may be used.

Figure 4:
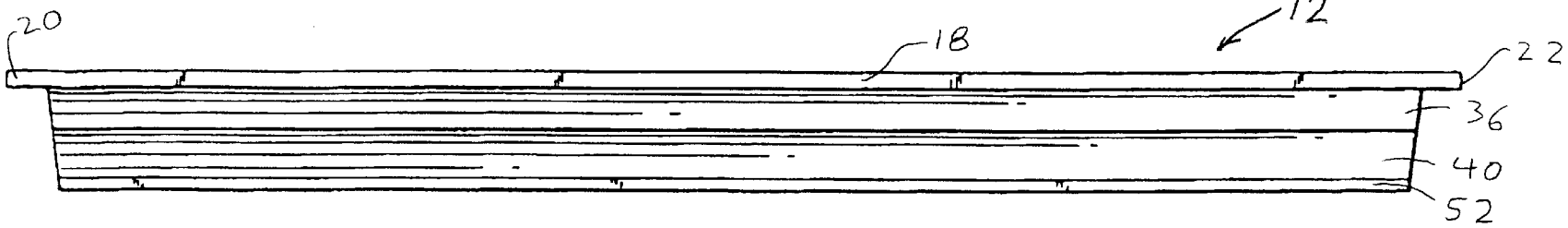
FIG. 4 is a side view of the stemware suspender in accordance with the embodiment of the FIG. 1.
Figure 3:
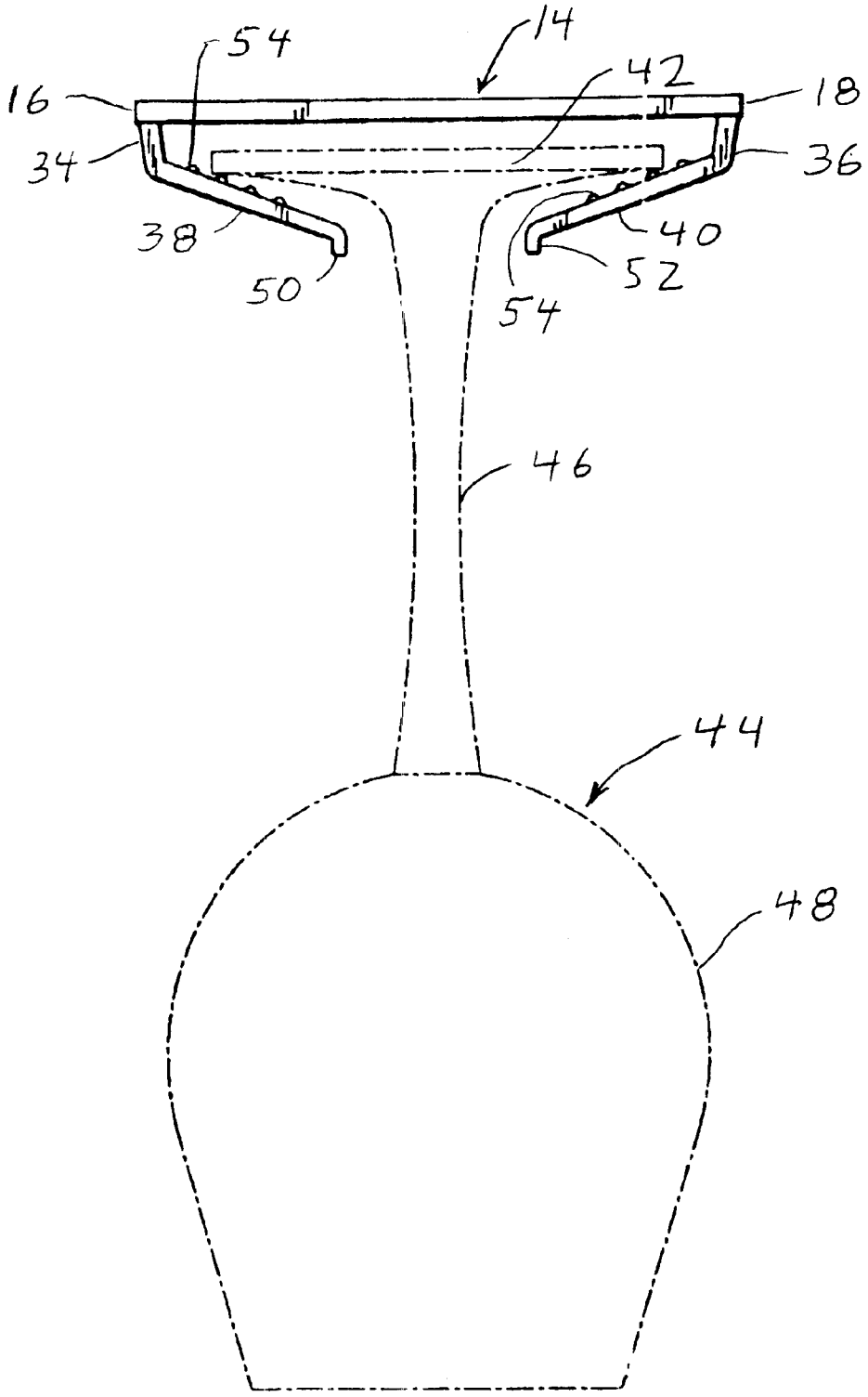
FIG. 3 is a front view of the stemware suspender in accordance with the embodiment of the FIG. 1.
Figure 5:
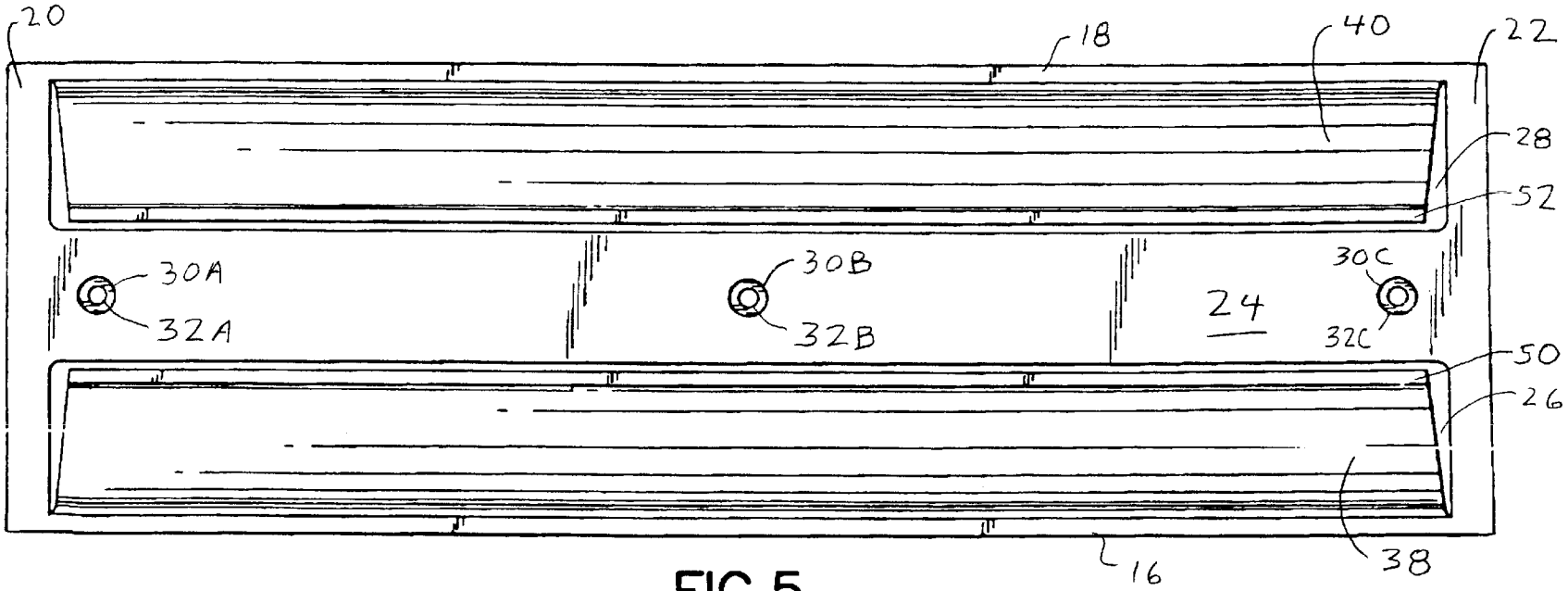
FIG. 5 is a bottom view of the stemware suspender in accordance with the embodiment of the FIG. 1.
Figure 6:
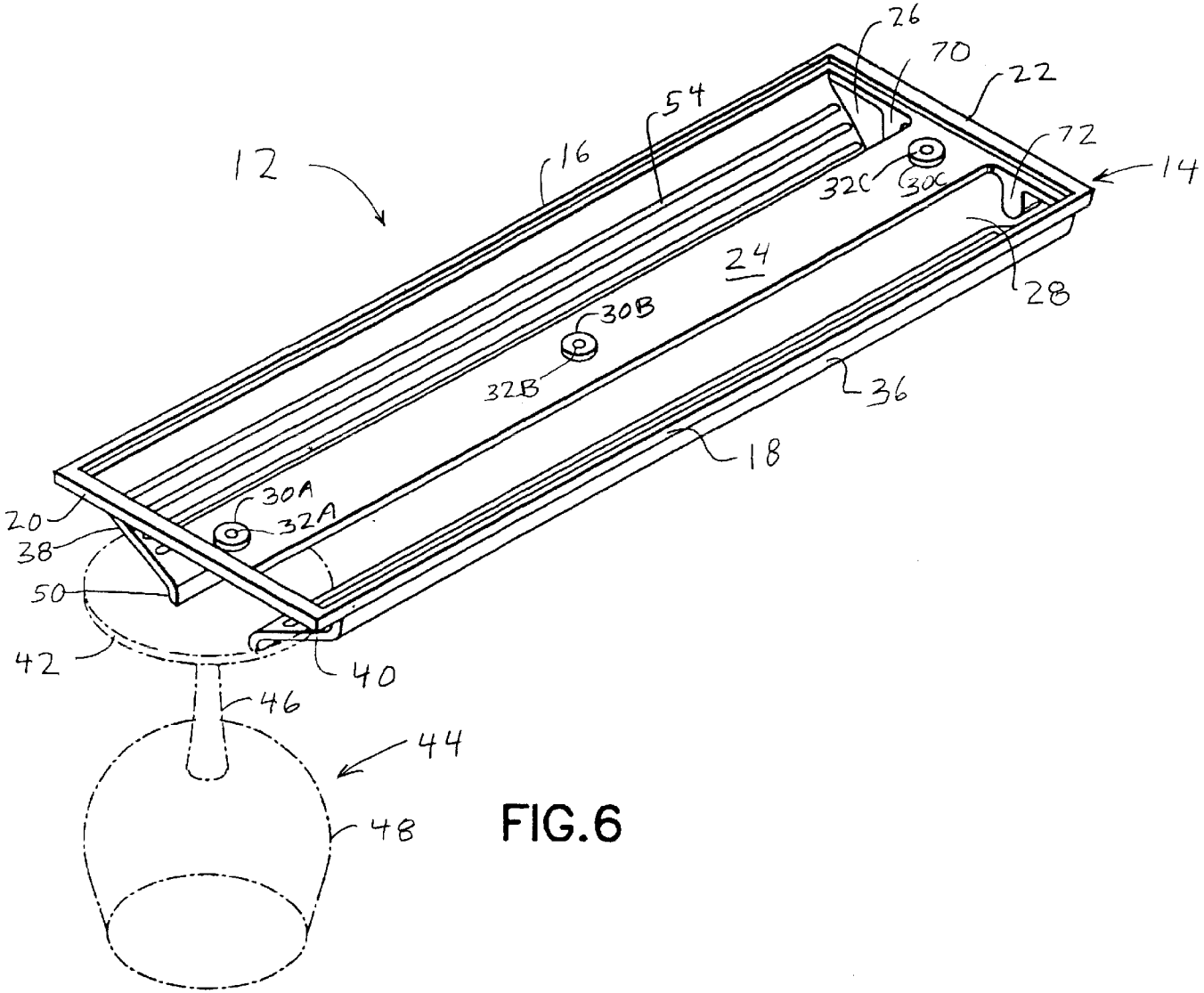
FIG. 6 is a perspective view of a stemware suspender in accordance with a second embodiment of the invention.
Figure 7:
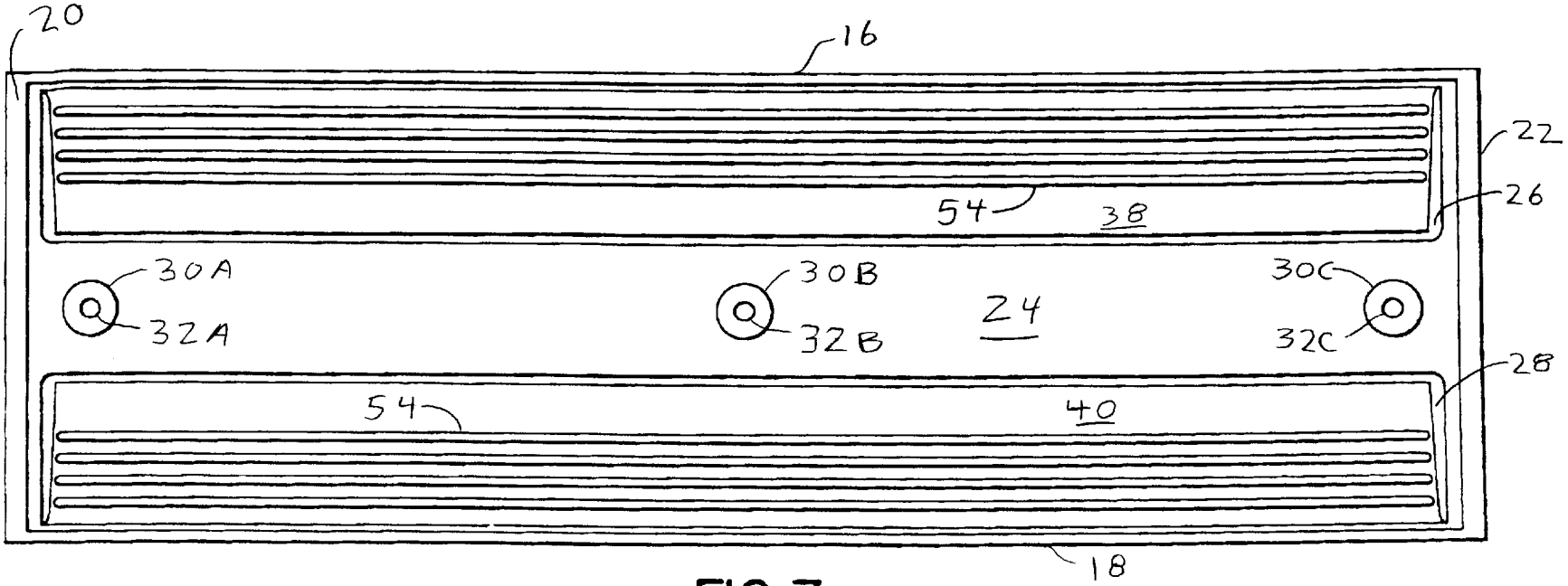
FIG. 7 is a top view of the stemware suspender in accordance with the embodiment of the FIG. 6.
Figure 9:
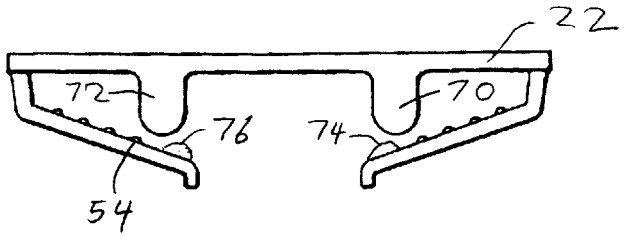
FIG. 9 is a rear view of the stemware suspender in accordance with the embodiment of the FIG. 6.
Figure 8:
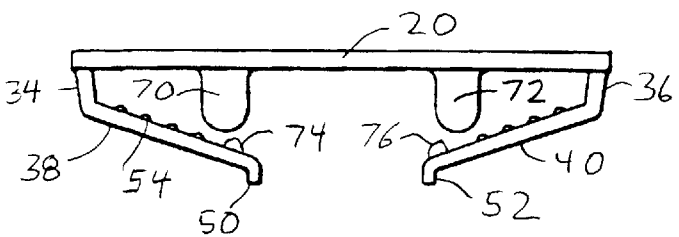
FIG. 8 is a front view of the stemware suspender in accordance with the embodiment of the FIG. 6.
Figure 10:
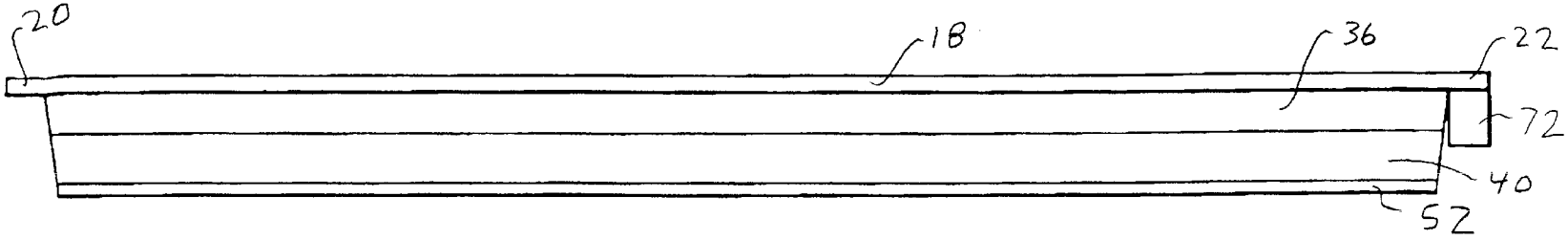
FIG. 10 is a side view of the stemware suspender in accordance with the embodiment of the FIG. 6.
Figure 11:
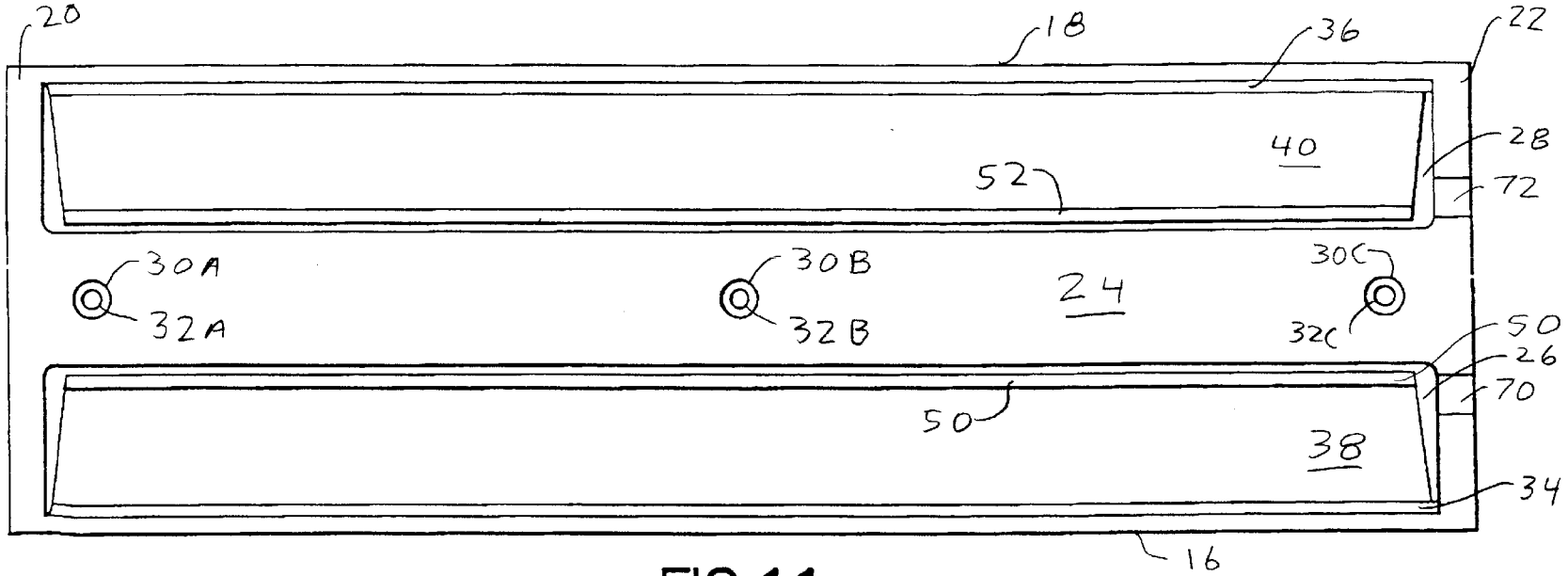
FIG. 11 is a bottom view of the stemware suspender in accordance with the embodiment of the FIG. 1.

Referring specifically to FIG. 3 and FIG. 4, each side member 16 and 18 has extending therefrom a respective side wall 34 and 36 in a direction generally perpendicular to frame 14, but with a slight slope inwardly toward each other as distance from frame 14 increases. Side walls 34 and 36 each have, extending from their respective ends distal from frame 14, a sloping support member 38 and 40 respectively, for supporting the base 42 of a piece of stemware 44. The stemware may be any of the type well known in the art, also including a stem 46 and a portion 48 for receiving a beverage. Support members 38 and 40 each terminate in respective end walls 50 and 52, which extend in a direction generally perpendicular to frame 14. The dimensions of support members 38 and 40 are such that end walls 50 and 52 are spaced apart from one another by a distance at least sufficient to allow the stem of any stemware that is to be held by suspender 12 to fit there between with a very comfortable clearance.

The sloping inner surfaces of support members 38 and 40 allow a piece of stemware to"self center" itself in the direction of left to right in FIG. 3. However, to assist in keeping the stemware vertical, a series of ribs 54 may be provided on the inner surfaces of support members 38 and 40. Ribs 54 are configured so as not to intrude on the effortless insertion and removal of stemware from suspender 12 but are just large enough to assist in centering and keeping stemware in an approximately vertical orientation within suspender 12.

It will be appreciated that the configuration of walls 34 and 36, support members 38 and 40, and end walls 50 and 52 is such as to allow injection molding of suspender 12. In other words, these parts fit within projections of openings 26 and 28, thus permitting relatively simple design of an injection mold for producing suspender 12.

Suspender 12 may be mounted to a variety of surfaces and in any one of several ways. Most commonly, it is mounted to the underside of a shelf in a dish cabinet. Permanent mounting may be accomplished by simply using an appropriate adhesive to secure the top surface of frame 14 to the underside of the shelf. To the extent that the distance to the shelf below is sufficient, and the stemware to be held is not too long, it is possible to have glasses, cups or other items on the shelf below, thus efficiently utilizing all of the available space. Another alternative is to use relatively short screws, such as wood screws, which extend through holes 32A, 32B and 32C and extend through the lower surface of the shelf, but not through the upper surface. Of course, this has the disadvantage that the shelves will be marred by the holes if it is decided to change the configuration of the items to be stored.

In accordance with the invention, this undesirable result can easily be avoided by using a clip 60 (FIG. 1) at each end of suspender 12 to secure it to the shelf. Such clips may be made of a springy metal material and may be advantageously dimensioned so as to have a lower portion 62 which extends under frame 14, a connecting portion 64 which extends upwardly perpendicularly thereto, and an upper portion 66 which may be forced over the top of a shelf (not shown). As illustrated in FIG. 1, advantageously two clips may be provided for each suspender 12, one for front member 20 and one for rear member 22, to support suspender 12 at its front and at its back. This installation is easily accomplished, and if carefully done, will not deface the shelf to which suspender 12 is secured. It will be recognized that suspender 12 may also be mounted on top of a shelf, with the opening between end walls 50 and 52 facing upward, to provide a very neat and organized way of securing stemware to a horizontal surface with the open end up. Thus also prevents tall stemware from falling over and being damaged.

A second embodiment of the invention is illustrated with respect to FIG. 6 to FIG. 11. It is similar in many respects to that of the first embodiment described above, and thus will not be described in detail, except in those instances where its structure departs from that of the first embodiment.

In this regard, specific reference is made to protrusions 70 and 72, which depend from rear member 22 of frame 14. This embodiment of the invention is particularly useful in those cases where suspender 12 is mounted, for example, on a low hanging ceiling member associated with an area where drinks are being served, such as the bar area of a restaurant, or in a home. In this case, elegant stemware may be on display, yet may be readily available for use when a customer or guest asks for a drink. Protrusions 70 and 72 prevent stemware form "falling out the back" of suspender 12. The absence of such protrusions enable stemware to be stored in and removed from suspender 12.

It is also possible for small protrusions 74 and 76 to extend upwardly from support members 38 and 40 a short distance so as to require that the base of stemware be lifted slightly for insertion and removal from suspender 12. This can be helpful in insuring that stemware is not accidentally removed from suspender 12, dropped and damaged.

Figure 12:
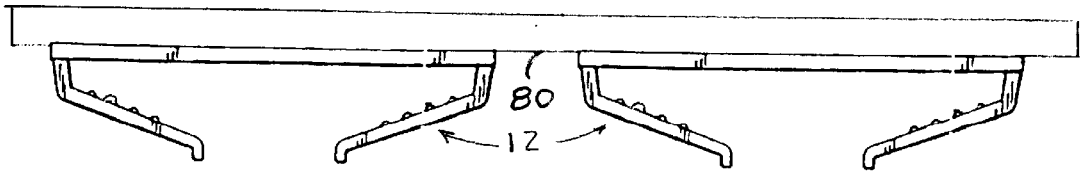
FIG. 12 is an end view of stemware suspenders according to the invention placed on a planar base.

Referring to FIG. 12, a plurality of stemware suspenders 12 in accordance with the invention are mounted on a rectangular base plate 80. Base plate 80 may be formed of the same material as stemware suspenders 10 and may be a fixed there to by any conventional means such as an appropriate adhesive, or suitable fasteners. As an alternative, stemware suspenders 10 may be integrally formed with base plate 80.

While two stemware suspenders are shown in FIG. 12, if base plate 80 is made larger, more stemware suspenders may be affixed to or integrally formed with base plate 80. The stemware suspenders should be mounted on base plate 80 so that they are parallel to one another. Further, sufficient space should exist between them so that stemware can be accommodated in the stemware suspender without interference between stemware in adjacent stemware suspender.

Figure 13:
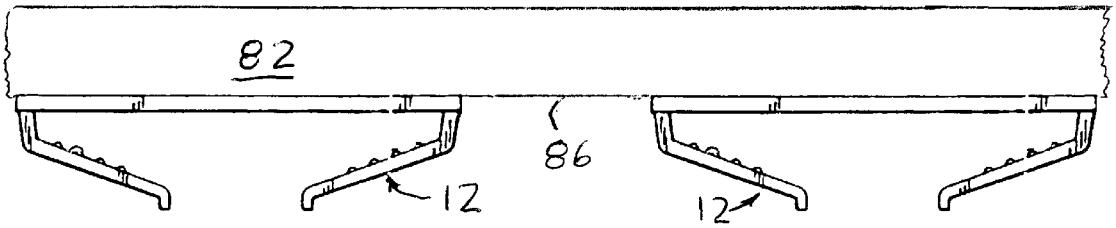
FIG. 13 is a side elevational view of a mounting arrangement for the stemware suspenders of the present invention.
Figure 13:
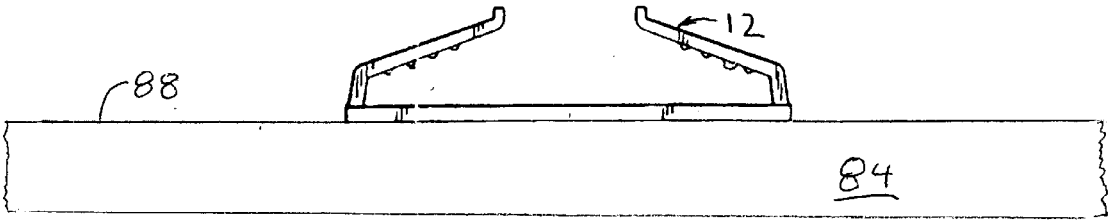

Referring to FIG. 13, the stemware suspenders of the present invention are arranged in the space between two shelves 82,84 (or a shelf and the top or bottom of a cabinet) so that the stemware is suspended from the top, and held from the bottom. The stemware suspenders must be spaced a sufficient distance from one another in the horizontal direction so that there is no interference between those pieces suspended from suspenders 12 mounted to the top surface 86 and those resting in a stemware suspender affixed to the bottom surface 88. The top surface 86 and bottom surface 88 are in facing relationship to one another.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. A stemware suspender comprising:

a generally rectangular frame; and a support member extending along each of two parallel sides of said frame, said support members being sized, shaped and positioned so as to define an opening therebetween for receiving a base of a piece of stemware between said support members and said frame, said support members extending away from and being angled with respect to said frame so that said base of said piece of stemware is centered between opposite sides of said frame when said base is supported in said suspender by said support members; and said frame having a web, said web having openings aligned with and at least as large as projections from said support members onto said frame.

2. The stemware suspender of claim 1, further comprising a plurality of parallel ribs on an inner surface of each of said support members, said ribs being for contacting said base of said stemware and for further assisting in centering said stemware.

3. The stemware suspender of claim 1, further comprising an end wall extending from each of said support members in a direction substantially perpendicular to a plane defined by said frame.

4. The stemware suspender of claim 1, further comprising:

a side wall disposed between each of said support members and said frame.

5. The stemware suspender of claim 4, wherein said side walls are angled towards each other as distance from said frame increases.

6. The stemware suspender of claim 1, wherein said web has a plurality of openings therein for receiving a fastener for fastening said suspender to a surface.

7. The stemware suspender of claim 6, further comprising:

a boss associated with each of said openings, said boss having a surface in a common plane with a surface of said frame.

8. The stemware suspender of claim 6, wherein said plurality of openings comprise three openings.

9. The stemware suspender of claim 1, wherein said frame has a planar surface, said planar surface being for abutting a surface to which said suspender is to be mounted.

10. The stemware suspender of claim 1, in combination with a clip for fastening said suspender to a support structure.

11. The stemware suspender of claim 1, in combination with a clip for fastening said suspender to a shelf.

12. The stemware suspender of claim 1, further comprising:

at least one protrusion extending from said frame at an end of said frame, said protrusion being sized, shaped and positioned so as to prevent accidental removal of said stemware from said suspender.

13. The stemware suspender of claim 12, wherein said frame has two protrusions extending from said frame.

14. The stemware suspender of claimed 1, further comprising:

at least one protrusion extending from one of said support members at an end of said support member, said at least one protrusion being sized, shaped and positioned so as to prevent accidental removal of said stemware from said suspender.

15. The stemware suspender of claim 14, wherein each of said support members has a protrusion extending from said support member.

16. The stemware suspender of claim 1, wherein said support members each having a portion of substantially uniform thickness, said portion having a flat outer surface, said portion having a plurality of parallel ribs disposed only on an inner surface of the portion of each of said support members, said ribs being for assisting in centering said stemware in said suspender.

17. The stemware suspender of claim 1, formed as an injection molded article.

18. An apparatus for supporting stemware comprising:

a planar base;

a plurality of stemware suspenders affixed to one side of said base, each stemware suspender including:

a generally rectangular frame;

a support member extending along each of two parallel sides of said frame, said support members being sized, shaped and positioned so as to define an openings therebetween for receiving a base of a piece of stemware between said support members and said frame, said support members extending away from and being angled with respect to said frame so that said base of said piece of stemware is centered between opposite sides of said frame when said base is supported in said suspender by said support members; and said frame having a web, said web having openings aligned with and at least as large as projections from said support members onto said frame.

19. The stemware suspender of claim 18, further comprising:

at least one protrusion extending from one of said support members at an end of said support member, said at least one protrusion being sized, shaped and positioned so as to prevent accidental removal of said stemware from said suspender.

20. The apparatus of claim 18, further comprising means for mounting said base to a surface.

21. A method for mounting stemware suspenders to two parallel surfaces in facing relationship, comprising:

providing a plurality of suspenders;

providing each of the suspenders with a generally rectangular frame, and a support member extending along each of two parallel sides of said frame, said support members being sized, shaped and positioned so as to define an opening therebetween for receiving a base of a piece of stemware between said support members and said frame, said support members extending away from and being angled with respect to said frame so that said base of said piece of stemware is centered between opposite sides of said frame when said base is supported in said suspender by said support members, and said frame having a web, said web having openings aligned with and at least as large as projections from said support members onto said frame;

mounting some of the plurality of stemware suspenders to a first surface of said parallel surfaces;

mounting at least one of said stemware suspenders to a second of said parallel surfaces;

said stemware suspenders being placed on said first surface and on said second surface so that stemware placed in said plurality of suspenders on said first surface is disposed on either side of stemware placed in said at least one suspender on said second surface.

22. A kit of parts comprising:

at least one stemware suspender, each stemware suspender including:

a generally rectangular frame;

a support member extending along each of two parallel sides of said frame, said support members being sized, shaped and positioned so as to define an openings therebetween for receiving a base of a piece of stemware between said support members and said frame, said support members extending away from and being angled with respect to said frame so that said base of said piece of stemware is centered between opposite sides of said frame when said base is supported in said suspender by said support to members; and said frame having a web, said web having openings aligned with and at least as large as projections from said support members onto said frame; and fastening means for fastening said stemware suspender to a surface.

23. The kit of claim 22, wherein said fastening means comprises at least one selected from the group consisting of:

an adhesive;

a plurality of screws;

a plurality of nails; and a plurality of shelf clips.

* * * * *